US005176084A

United States Patent [19]

Keeton

[11] Patent Number: 5,176,084

[45] Date of Patent: Jan. 5, 1993

[54] KNIFE ASSEMBLY FOR AUTOMATIC SEWING MACHINES

[76] Inventor: J. Herbert Keeton, P.O. Box 296, 747 Meader St., Campbellsville, Ky. 42718

[21] Appl. No.: 701,075

[22] Filed: May 16, 1991

[51] Int. Cl.[5] ..... D05B 65/00; D05B 65/06

[52] U.S. Cl. ..... 112/288; 112/287; 112/301; 112/DIG. 1

[58] Field of Search ..... 112/288, 285, 287, 291, 112/293, 296, 301, DIG. 1, DIG. 2; 83/902, 402, 98, 100, 639.1

[56] References Cited

U.S. PATENT DOCUMENTS

| | | | |
|---|---|---|---|
| 3,143,878 | 8/1964 | Daniel et al. | 112/287 X |
| 3,541,984 | 12/1970 | Daniel | 112/288 X |
| 3,624,734 | 12/1971 | Schips | 112/288 X |
| 3,749,040 | 7/1973 | Jurgens | 112/288 X |
| 3,815,533 | 6/1974 | Bray | 112/288 X |
| 4,091,756 | 5/1978 | Von Hagen | 112/288 X |
| 4,332,209 | 6/1982 | Gauch | 112/288 X |
| 4,523,535 | 6/1985 | Blackburn | 112/288 |
| 4,599,961 | 7/1986 | Brusasca | 112/287 |
| 5,052,318 | 10/1991 | Ackermann | 112/288 |

*Primary Examiner*—Andrew M. Falik
*Assistant Examiner*—Paul C. Lewis
*Attorney, Agent, or Firm*—Nixon & Vanderhye

[57] ABSTRACT

A thread cutting knife assembly for an automatic sewing machine cuts leading and trailing threads during the stitching of garments so that very little tail is left. The body member of the assembly has an open top cavity and first and second ends spaced from each other in a first dimension, which includes a first direction in which the thread passes with respect to the assembly under the influence of the sewing machine feed dogs. A top plate covers the body member cavity open top, and a movable cutting element is disposed between the top plate and the body member and is reciprocated to effect cutting of the thread. Air flow within the cavity from the first end of the body toward the second end in the first direction is effected by supplying air under pressure to an opening at the body first end. Another opening at the body first end can also be provided into which atmospheric air is drawn to provide a Venturi effect. The movable cutting element is reciprocated by a cam in the first direction, and returns to effect cutting under a spring bias. A pneumatic actuator may alternatively be provided for reciprocating the movable cutting element, and includes an O-ring movable with, and then with respect to, an interior bore in a piston to block, and then uncover, a vent passage, to thereby limit the stroke of the cutting element as powered by the actuator. A groove or cavity is defined in the top plate to guide the thread to the movable blade for effective cutting.

19 Claims, 4 Drawing Sheets

FIG. 3
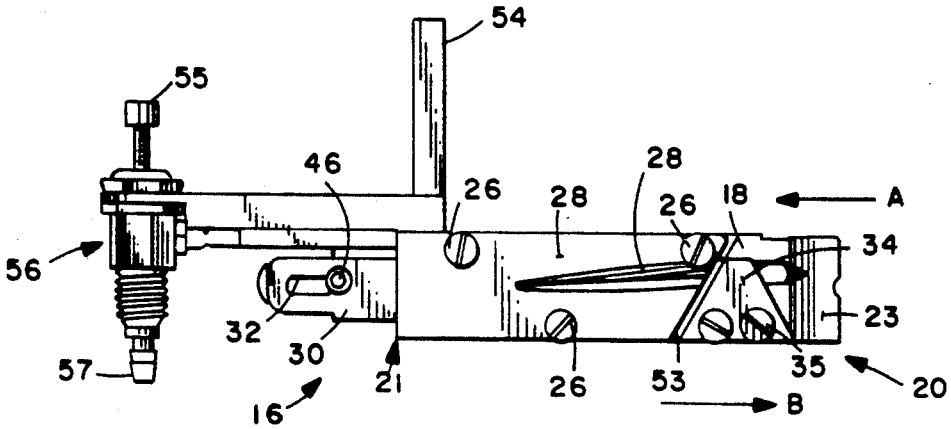
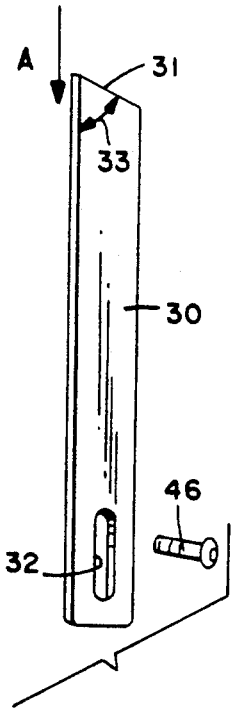
FIG. 6
FIG. 5
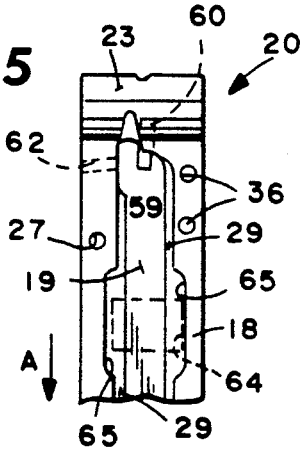
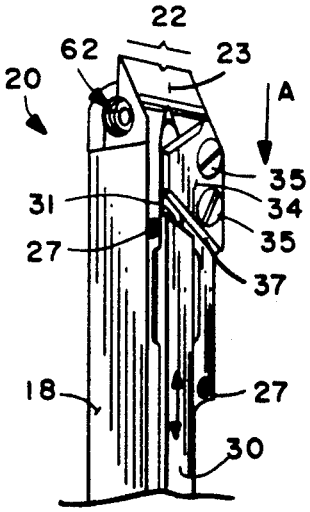
FIG. 4
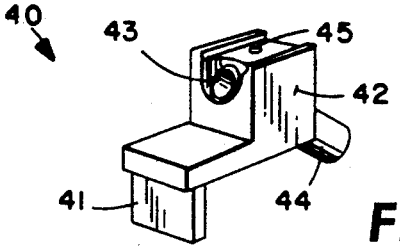
FIG. 7

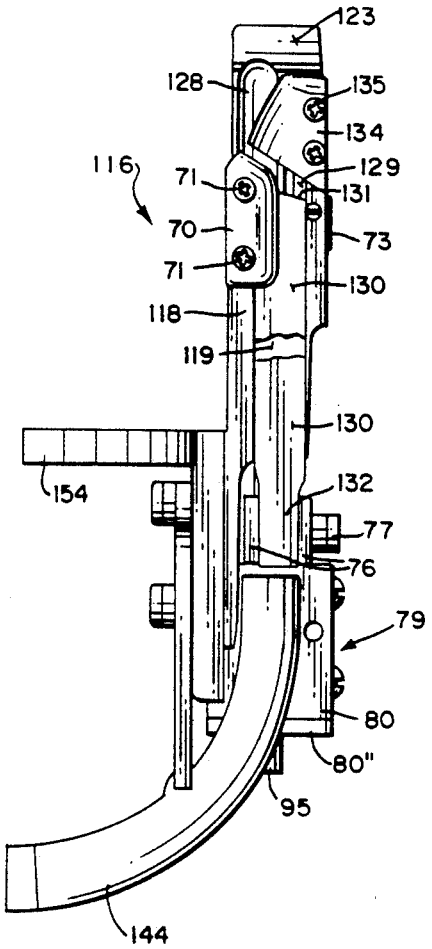
FIG. 8
FIG. 10
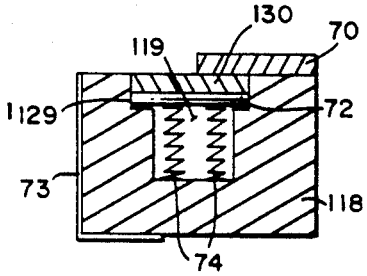
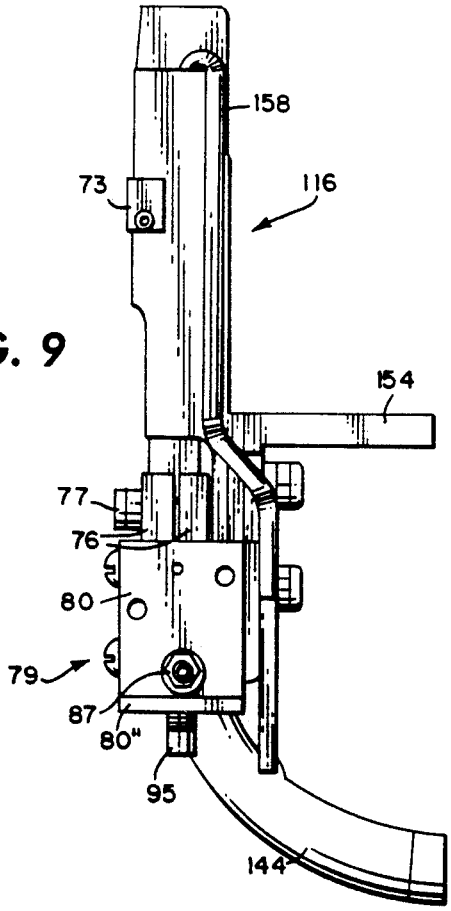
FIG. 9

KNIFE ASSEMBLY FOR AUTOMATIC SEWING MACHINES

BACKGROUND AND SUMMARY OF THE INVENTION

In the manufacture of garments utilizing automatic sewing machines, it is necessary to provide some sort of a knife assembly in order to cut the leading and/or trailing threads which effect stitching of the garment. Typically a scissors action type cutting element is provided just downstream of the automatic sewing machine throat plate in the direction of garment movement, and a vacuum is utilized to draw the thread into operative association with the scissors type cutter, and then to carry away the cut thread. Utilizing such a conventional structure—standard equipment with Union Special Corporation type sewing machines—cutting may be effectively practiced, however the amount of thread tail remaining is typically on the order of about one inch. Also, in the prior art, the garment itself sometimes is sucked into contact with the knife, resulting in change to the garment or temporary cessation of the cutting action.

According to the present invention, a thread cutting knife assembly for an automatic sewing machine, and in combination with an automatic sewing machine, is provided which allows the leading or trailing thread to be cut much more closely to the garment than in the prior art, the apparatus according to the invention essentially allowing the thread to be cut right at the garment. This very advantageous action is provided by the particular design and orientation of a top plate of the assembly defining a surface over which the thread passes, the particular cutting elements, and the means for effecting air flow.

According to one aspect of the present invention a thread cutting knife assembly for an automatic sewing machine comprises: A top plate defining a surface over which thread passes. The top plate having means defining a groove in the top plate elongated generally in a first dimension. A body member having an open top cavity therein, and a first end and a second end, the first and second ends spaced from and opposite each other in the first dimension [the top plate covers the body member cavity open top]. A movable cutting element elongated in the first dimension, and disposed between the top plate and the body member, having a cutting portion at a first end thereof adjacent the body first end, and an engagable portion at a second end thereof spaced from and opposite the first end in the dimension of elongation. A stationary cutting element positioned closer to the body first end than the top plate is positioned, and disposed over the body cavity. Means for reciprocating the cutting element in the first dimension, the means engaging the engagable portion of the movable cutting element. And, means for effecting air flow within the cavity from the body first end toward the body second end in the first dimension.

The air flow effecting means preferably comprises a flexible material tube extending outside the body from connection to a source of air under pressure adjacent the body second end to a first opening in the first end of the body, so as to provide a flow of air under pressure in the cavity. Moving the thread in a blown stream of air allows better control over the thread than in a purely suction stream. Also, it is desirable to provide a second opening in the first end of the body adjacent the first opening open to the atmosphere so that compressed air passing through the tube entrains atmospheric air which also passes through the cavity under a Venturi effect. This air flow entrains the cut thread, and passes it to a disposal area.

The cutting portion of the movable cutting element preferably makes an angle of about 45°–75° with respect to the first dimension, in the direction from the first end to the second end. Also the body is open at the second end and the means for reciprocating the movable cutting element comprises means defining a passage away from the body in fluid communication with the body second end. For example, the means for reciprocating the cutting element may further comprise a cam engaging element, the passage being defined in the cam engaging element so that it normally moves the first end of the movable cutting element into engagement with the stationary cutting element. The body first end has a termination slanting downwardly from the body cavity open top, and the flexible tube enters the first opening beneath that end termination.

The assembly according to the present invention is preferably part of an automatic sewing machine. That is, according to the invention an automatic sewing machine is provided including a sewing needle, a pressure foot, a throat plate, feed dogs, and a leading or trailing thread cutting knife assembly. The knife assembly is operatively positioned with respect to the sewing needle, pressure foot, throat plate, and feed dogs to receive cloth stitched with thread by the needle, the cloth moving in a first direction in a first dimension with respect to the knife assembly. The knife assembly is as described above. It cooperates with cams also forming part of the automatic sewing machine.

Utilizing the apparatus according to the present invention, less air is needed than in conventional automatic sewing machine cutting mechanisms, and there is better control over the thread in the air stream. Also, a reciprocating action is provided for effecting cutting of the thread rather than a scissors action, which allows a construction that minimizes the cloth entering the cutting mechanism, but maximizes the probability that the thread will be properly positioned for cutting. Utilizing the invention it is possible to trim the thread very close to the leading and trailing edges of the garments, e.g. leaving only a few millimeters of thread tail rather than one inch as in the prior art.

The invention also contemplate a particular pneumatic actuator which may be used to reciprocate the movable cutting element of the knife assembly, or in other circumstances where a pneumatic actuator of a small, predetermined stroke length is desired. The pneumatic actuator according to the invention is for reciprocating a reciprocal element, and comprises the following elements: A body defining an interior cylindrical bore, having means defining an opening therein for introduction of gas under pressure. A piston including a shaft for connection to the reciprocal element, and a piston face which is engaged by gas under pressure, the piston mounted in the cylinder for reciprocal movement therein. Means defining an opening in the piston face, including an interior bore parallel to the cylindrical bore. A stationary rod extending from the body into the piston interior bore. An O-ring having an outside diameter, and compressibility, such that the O-ring can sealingly engage the piston interior bore and prevent gas from passing therepast. Means for mounting the O-ring with respect to the piston so that O-ring moves with the piston, providing a gas-tight seal preventing gas from the cylindrical bore opening passing into the piston interior bore, a first distance, and after the O-ring and piston have moved together the first distance the piston continues to move while the O-ring does not so that there is relative movement therebetween and the seal between the O-ring and the piston interior bore is broken, and gas from the cylindrical bore opening may freely pass into the piston interior bore; and vent means for venting gas passing into the piston interior bore.

Preferably the means for mounting the O-ring comprises a rod fixed to the body and extending into the piston interior bore, substantially parallel to the cylindrical bore. The rod has a shoulder which acts on the O-ring to instigate the relative movement between the O-ring and piston, and the vent means comprises means defining an opening in the rod, and an interior passageway in the rod extending to a point in operative communication with the exterior of the body. Desirably, spring means are provided for biasing the O-ring on the rod in a direction opposite the direction of movement thereof with the piston in response to gas under pressure being introduced into the cylinder, and spring means are also provided for biasing the piston in a direction opposite to the direction of movement thereof in response to gas under pressure being introduced into the cylinder.

It is the primary object of the present invention to provide for the effective trimming of thread from the leading and/or trailing edges of garments stitched by an automatic sewing machine. This and other objects of the invention will become clear from an inspection of the detailed description of the invention, and from the appended claims.

BRIEF DESCRIPTION OF THE DRAWINGS

FIG. 3 is a top plan view of the assembly of FIG. 2;

FIG. 4 is a top perspective view of the leading end portion of the assembly of FIGS. 2 and 3;

FIG. 5 is a top plan detail view of the leading end portion of the assembly of FIG. 4 with the cutting elements removed for clarity of illustration;

FIG. 6 is a perspective view of the movable cutting element of the assembly of FIGS. 2 through 4;

FIG. 7 is a rear perspective view of the cutting element actuator of the assembly of FIGS. 2 and 3;

FIG. 8 is a view like FIG. 3 of a second embodiment of thread cutting knife assembly according to the invention;

FIG. 9 is a bottom plan view of the FIG. 8 embodiment;

FIG. 10 is a longitudinal cross-sectional view of the embodiment of FIGS. 8 and 9 taken at a blade biasing portion thereof;

DETAILED DESCRIPTION OF THE DRAWINGS

Figure 1:
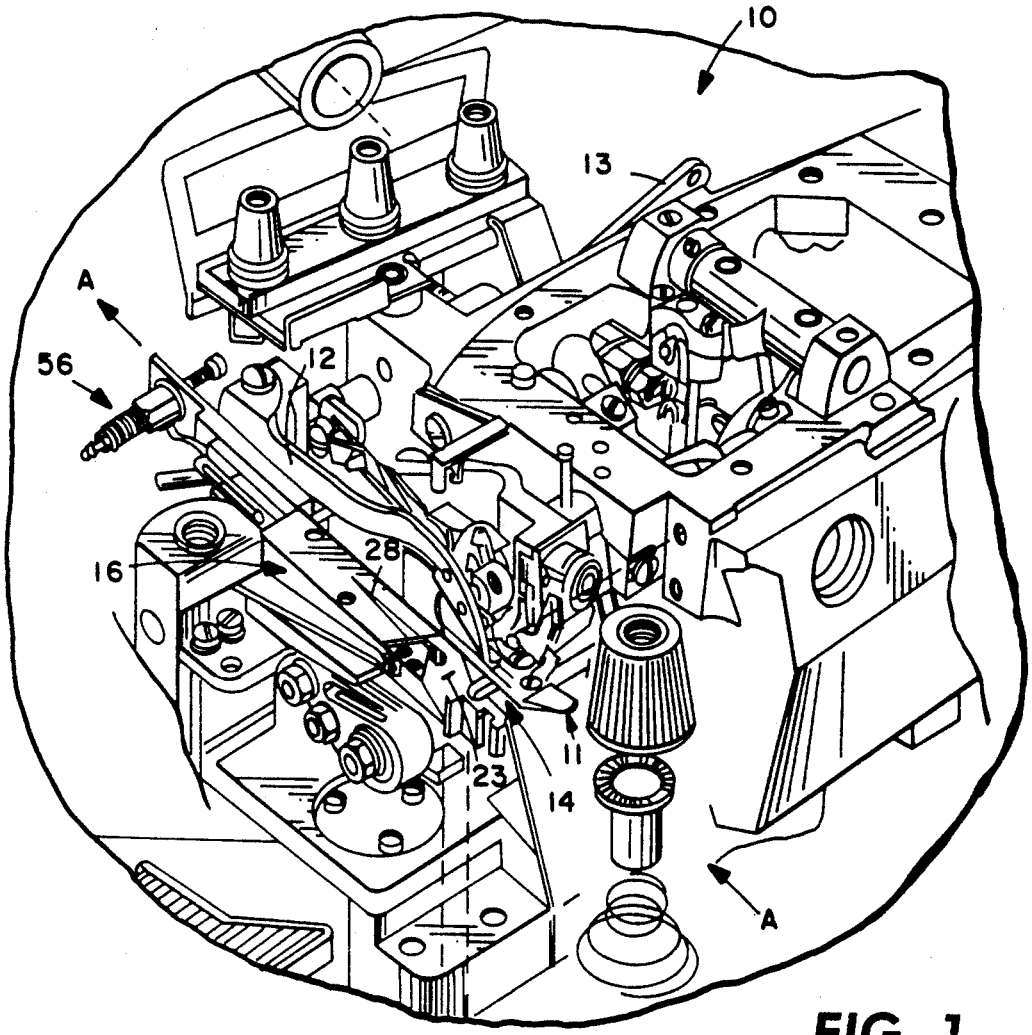
FIG. 1 is a perspective view of an exemplary automatic sewing machine according to the invention, with a number of components removed for clarity of illustration.
Figure 2:
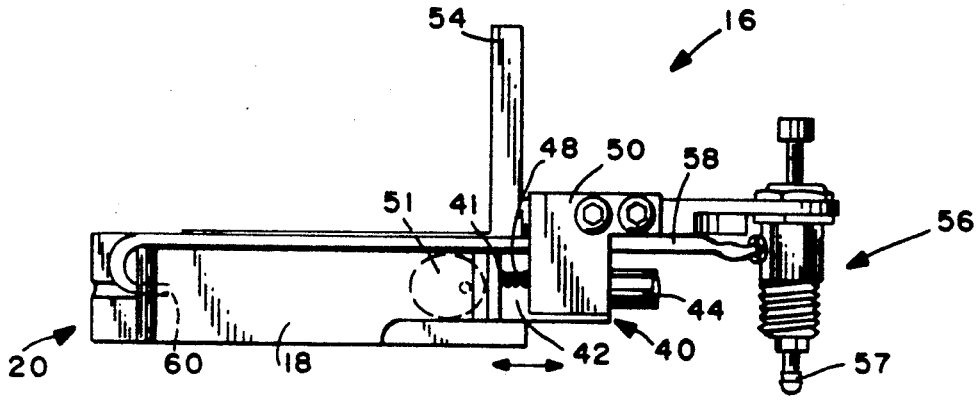
FIG. 2 is a bottom plan view of a first embodiment of an exemplary thread cutting knife assembly according to the present invention.
Figure 11:
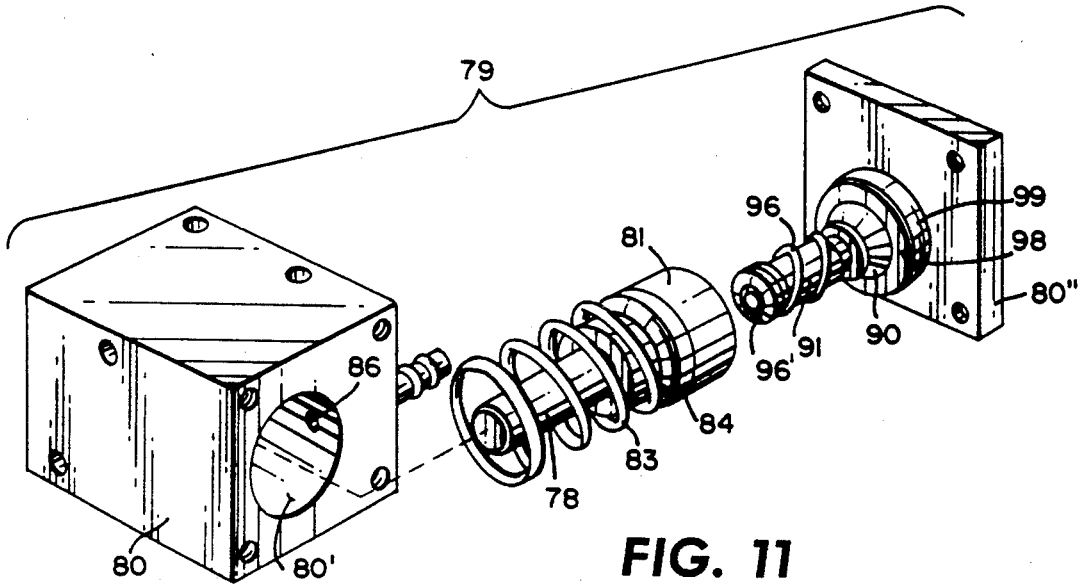
FIG. 11 is a perspective exploded view of the components of the pneumatic actuator for reciprocating the blade of the second embodiment.

An exemplary automatic sewing machine according to the invention is shown generally by reference numeral 10 in FIG. 1. The sewing machine includes all conventional parts, including a presser foot 11 mounted on a presser arm 12, a foot lifter lever 13, a throat plate 14 beneath the presser foot, and conventional feed dogs and a conventional sewing needle, not shown in FIG. 1. Just "downstream" of the presser foot in the direction of garment movement A is a thread cutting knife assembly 16 according to the present invention.

A first embodiment of a knife assembly assembly 16 according to the invention is illustrated in detail in FIGS. 1-7, and includes a body member 18 having a cavity—best seen at 19 in FIG. 5—with an open top along the majority of its length. The body has a first end 20, and a second end 21 in the direction A, with the first end 20 having a termination 22 including a downwardly slanting surface 23. The leading edge 23 cams the garment upwardly from the throat plate to the top of the body 18 to move the thread thereon in operative association with the cutting elements hereafter described.

The assembly 16 further includes a top plate 25 held onto the top of the body 18 by screws 26 for closing the majority of the open top of the cavity 19, screw holes 27 for screws 26 being seen in FIGS. 4 and 5. The top plate 25 defines a surface over which the thread on the garment passes, and the plate 25 has means defining a tapered groove 28 therein. The groove 28 has its largest depth at its closest point to the first end 20 of the body (adjacent the leading end of the top plate 25), and its smallest depth portion furthest away from the first end 20; the groove 28 also is widest where it is deepest, and narrowest where it is shallowest. The groove 28 is elongated generally in the first direction A (which encompasses a first dimension including the direction A and its opposite direction B), although not necessarily exactly in the direction A (e.g. slanted with respect thereto a few degrees as illustrated in FIG. 3).

Disposed below the top plate 25, between it and the body 18, on guide shelf 29, is a movable cutting element 30, seen most clearly in FIGS. 3, 4, and 6. The cutting element 30 has a cutting portion 31 at a first end thereof, closest to the first end 20 of the body 18, and an engageable portion, such as the elongated slot 32, at a second end thereof opposite the first end and having the cutting portion 31. As seen in FIGS. 4 and 6, the cutting end 31 is preferably disposed at an angle with respect to the first direction A, typically an angle 33 (see FIG. 6) of about 45°-75° with respect to the direction A. The movable cutting element 30 cooperates with a stationary cutting element 34 which is held onto the top of the body 18 in front of the top plate 25 by screws 35 cooperating with openings 36 in the body 18 (see FIGS. 4 and 5) and also covering the top of the cavity 19 at a leading portion thereof. The stationary cutting element 34 has a cutting edge 37 which cooperates with the leading edge 31 of the movable cutting element 30.

At the engageable portion of the cutting element 30–e.g. at the elongated slot 32–a structure is connected to the element 30 for reciprocating it in the first dimension (in the first direction A, and direction B opposite thereto) including a structure 40 (see FIGS. 2 and 7 in particular) having a cam engaging surface 41, a main body 42 having means defining a passage 43 therein (including the tube 44), and a screw hole 45 on the top surface thereof for receipt of a screw 46 which passes through the elongated opening 32, and when tightened down positively connects the structure 40 to the cutting element 30. A spring 48—preferably a coil string located in recessed openings in the cam engaging surface 41 and stationary block 50—provides a biasing force normally biasing the movable cutting element 30 in the second direction B, opposite the first direction A (see FIG. 3). A conventional, pre-existing—or added, depending upon the type of sewing machine—cam—shown in dotted line at 51 in FIG. 2—is used to move the movable cutting element 30 in the first direction A so that thread may pass between the top plate 25 and stationary cutting element 34 (see the gap 53 in FIG. 3), while the coil spring 48 returns it to its normal position, and effects cutting of the thread when returned.

The assembly 16 is stationarily mounted on the rest of the automatic sewing machine 10 utilizing the block 50 and bracket 54, integrally connected to the block 50. Typically through extending openings (not shown) as provided in the bracket 54 for receipt of screw fasteners which attach the assembly 16 to the rest of the sewing machine 10.

Means are also provided for providing an air flow within the cavity 19 from the body first end 20 toward the second end 21 thereof, i.e. in the first direction A. The air flow is preferably provided—not by a vacuum—but by compressed air, and a Venturi arrangement, which provides maximum control over the thread during cutting, yet still quickly and effectively whisks the severed thread away from the cutting site. The air flow effecting means comprises means for effecting air flow under pressure, and includes a regulator 56, with adjusting screw 55, mounted to the stationary block 50 and connectable via end termination 57 thereof to a source of compressed air, and a small diameter tube 58 (e.g. of rubber, metal, or plastic) leading from the regulator 56 from the second end 21 of the body 18 to the first end 20 thereof, the free end 59 of the tube 58 passing through a first opening 60 in the first end 20 of the body 18, and pointing in the cavity 19 in the first direction A (see FIG. 5). It is preferable that a second opening 62—see FIG. 4—also be provided adjacent the first end 20 of the body 18, typically in the extension 22 thereof, which is open to the atmosphere, so that compressed air passing through the free end 59 of the tube 58 entrains atmospheric air therein which also passes through the cavity 19 under a Venturi effect. The air—as well as any cut thread entrained thereby—ultimately passes through the passageway 43, and tube 44 thereof, the tube 44 being connected up to a conventional disposal area, a vacuum, or the like.

As an optional feature, in order to facilitate replacement of the movable cutting element 30, an upwardly bowed spring plate 64 (see FIG. 5) may be provided in recessed portions 65 of the body 18 adjacent the open top thereof.

In the typical operation of the automatic sewing machine 10 according to the invention, the garment to be stitched is fed under the presser foot 11 over the throat plate 14 in the first direction A, and after stitching engages the leading surface 23 of the assembly 16, and moves upwardly to ultimately move over the top plate 25. The groove 28 facilitates proper location of any thread tail from either the front or rear of the garment, and the cam 51 engages the cam follower 41 to effect reciprocation of the movable cutting element 30 in the direction A to open up the gap 53 between the top plate 25 and the stationary cutting element 34. Air under pressure is supplied through the tube 58 from a source of compressed air connected to the pressure regulator 56, and—combined with air entrained by Venturi effect through the opening 62—rushes in the direction A and entrains the thread therein, causing the thread only (not the cloth) to move through the gap 53. Once the cam 51 is no longer moving the follower 41 in the direction A, the coil spring 48 returns the movable element in the direction B, and the reciprocating action between the elements 30, 34 effects cutting of the thread, very close to the garment (e.g. only a few millimeters therefrom rather than an inch as in the prior art). The cut portion of the thread entrained in air passes through the cavity 19 out through the passage 43 including the tube 44, for ultimate disposal. This operation can be, and is, repeated for both the leading and trailing edge of every garment passing therethrough.

The second embodiment of the invention, illustrated in FIGS. 8 through 12, while functionally equivalent to the first embodiment, has a few changes which may be desirable in some circumstances. In the FIGS. 8 through 12 embodiment structures comparable to those in the FIGS. 1 through 7 embodiment are illustrated by the same reference numeral only preceded by a "1".

In the FIGS. 8 through 12 embodiment, note that the structure 128 into which the thread is drawn is more of a cavity rather than a groove, allowing the thread to pass in easily at the front thereof. At the opposite end of the second embodiment of the assembly 116, the tube 144 for withdrawing the cut thread is much larger than in the first embodiment. Also in this embodiment the manner in which the cutting element 30 is biased upwardly is different. As seen in FIG. 8, a plate 70—in addition to the structure 134 comprising the stationary blade—is disposed on top of the cutting element 30 to guide it in its reciprocation, along shelf 129, holding the cutting element 130 down against spring bias (to be further described), and also functioning to deflect thread into the cavity 128 to effect proper cutting thereof. The hold down plate 70 is mounted by screws 71 to the body 118. Bias of the cutting element 130 is provided by the dowel 72 (see FIG. 10), which may be slid through an opening into engagement with the shelves 129 at the top of the channel 119, and is held in that position by a thin metal angle 73. The dowel 72 is held loosely vertically in association with the body 118, and is biased upwardly by springs 74 mounted in the channel 119.

The most significant change of the second embodiment 116 with respect to the first embodiment is the manner in which the cutting element 130 is reciprocated. At the second end 132 of the cutting element 130, opposite the cutting edge 131 thereof, the element 130 is thinned and is held between two clamping members 76 which are connected together by a screw threaded fastener 77. Those same clamping elements 76 are connected to a shaft 78 at the opposite end thereof from the cutting element 130. When the screw threaded fastener 77 is tightened, holding the clamping elements 76 together, they tightly clamp both the cutting element 130 and the shaft 78 so that the element 130 moves linearly when the shaft 78 does. This is illustrated schematically in FIG. 12, and also is partially illustrated in FIGS. 8 and 9.

The shaft 78 is reciprocated by a pneumatic actuator 79, and the pneumatic actuator 79 is believed to be novel per se. The pneumatic actuator 79 includes a body 80 defining a cylinder, including internal cylinder wall 80', with the open end of the cylinder defined by the wall 80' being closed off by the end wall 80" which is releasably held in place by a plurality of screws. Mounted for reciprocal movement within the cylinder body 80, engaging the cylindrical wall 80', is a piston 81. The piston 81 has a guide portion 82 over which a coil spring 83 seats, and a shoulder 84 engaged by one end of the coil spring 83. The opposite end of the coil spring 83 engages the closed end wall 85 of the body 80 (see FIG. 12). The shaft 78 reciprocates through an opening 85' disposed in the wall 85.

Air under pressure is supplied to the interior of the body 80 through small opening 86 near the open end of the body 80, the air being supplied by a hose connected to the barbed fitting 87, and also to a source of air under pressure 88. The air acts on the face 81' of the piston 81, to move it to the left as viewed in FIG. 12.

The piston 81 has an interior bore including interior bore defining wall 89 therein, and an O-ring, of elastic material, is disposed so that it can fit within the bore 89, being slightly compressed against the bore 89 so that it provides a seal preventing the flow of air from source 88 into the bore 89 as long as the O-ring 90 engages the bore 89.

The O-ring 90 is mounted on a rod 91 which is stationary with respect to the end wall 80". The rod 91 has means defining an opening 92 therein which communicates with a central bore 93 extending all the way out to the groove or channel 94 formed in a plastic screw 95. The air path provided by the opening 92, bore 93, and groove 94 allows the escape of gas from inside the bore 89 to the outside of the device 79. The O-ring is normally biased in the direction toward the right as viewed in FIG. 12 by a light coil spring 96 which is disposed around the rod 91, and engages shoulder 96' at one end thereof, and the O-ring 90 at the other end thereof. The rod 91 has a shoulder 97 located a distance—compared to the length of travel of the piston 81—corresponding to the desired length of travel of the cutting element 130. The connection of the rod 91 to the end cap 80', and the connection of the plastic screw 95 to the end cap 80', are sealed by a large O-ring 99 and metal plate 98.

Figure 12:
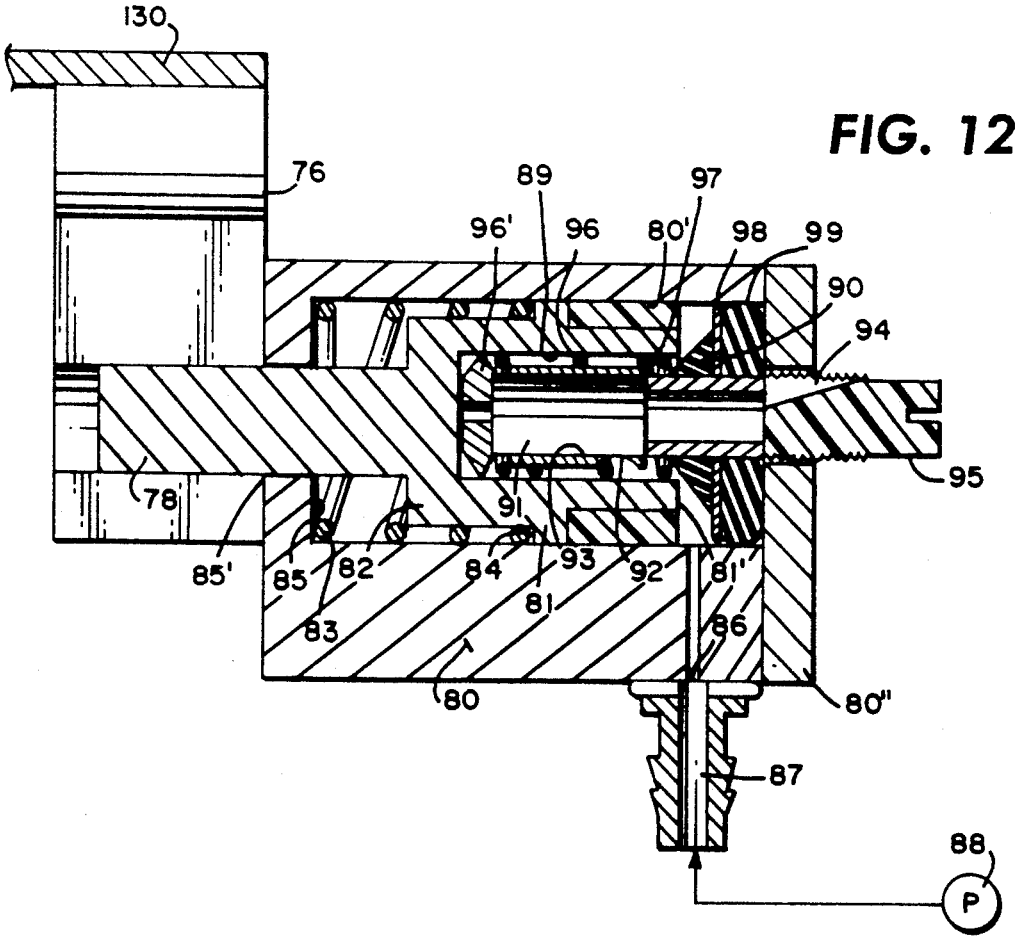
FIG. 12 is a side cross-sectional view of the actuator of FIG. 11, shown schematically attached to the cutting blade.

The operation of the actuator 79, illustrated in FIGS. 8, 9, 11 and 12, is follows:

When it is desired to reciprocate the cutting blade 130 to effect cutting of the thread within the cavity 128, air under pressure is provided through a valve (not shown) from the source 88 through the opening 86 so that it engages the face 81' of the piston 81, and the face of the O-ring 90 which is received within the bore 89. The piston 81 then reciprocates to the left as seen in FIG. 12, moving the blade 130 with it (acting through the clamp 76), to effect the cutting action. The end of the stroke is reached when the O-ring 90—moving left with the piston 81—engages the shoulder 97. When it engages the shoulder 97 it can no longer move easily to the left, but the piston 81 can, and since the piston 81 has a larger area on which the pressure from source 88 acts, the piston 81 will continue to move to the left so that there is relative movement between the piston 81 and the O-ring 90.

The relative movement between the piston 81 and the O-ring 90 eventually breaks the seal between the O-ring 90 and the bore 89. When the seal is broken, the air from source 88 no longer acts to push the piston 81 to the left, but rather passes through opening 92 in rod 91, through bore 93, and through groove 94, to be vented to the environment.

Once the pressure pulse from the source 88 is terminated, the springs 83 and 96 will return the piston 81 and O-ring 90, respectively, to their initial positions so that they will be ready for another actuating sequence. Of course as the piston 81 is moved to the right in FIG. 12 under the influence of the strong coil spring 83, the shaft 78 is similarly reciprocated to the right, and the cutting element 130 is moved to its non-cutting position. The screw 95 may be adjusted to adjust the exhaust groove 94, and thereby control the speed of operation of the actuator 79 (as does the air pressure and the air flow from source 88, which may pass through various valves or regulators of conventional design).

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A thread cutting knife assembly for an automatic sewing machine comprising:

a top plate defining a surface over which thread passes;

said top plate having means defining a groove in said top plate elongated generally in a first dimension;

a body member having an open top cavity therein, and a first end and a second end, said first and second ends spaced from and opposite each other in said first dimension;

said top plate covering said body member cavity open top;

a movable cutting element elongated in said first dimension, and disposed between said top plate and said body member,, having a cutting portion at a first end thereof adjacent said body first end, and an engagable portion at a a second end thereof spaced from and opposite said first end in said dimension of elongation;

a stationary cutting element positioned closer to said body first end than said top plate is positioned, and disposed over said body cavity;

means for reciprocating said movable cutting element in said first dimension, said means for reciprocating engaging said engagable portion of said movable cutting element; and means for effecting air flow within said cavity from said body first end toward said body second end in said first dimension.

2. A knife assembly as recited in claim 1 wherein said air flow effecting means comprises means for effecting a flow of air under pressure.

3. A knife assembly as recited in claim 2 wherein said air flow effecting means comprises a tube extending outside said body from connection to a source of air under pressure adjacent said body second end to a first opening in said first end of said body.

4. A knife assembly as recited in claim 3 wherein said cutting portion makes an angle of about 45°-75° with respect to said first dimension, from the body first end to second end.

5. A knife assembly as recited in claim 3 further comprising a second opening in said first end of said body adjacent said first opening, and open to the atmosphere, so that compressed air passing through said tube entrains atmospheric air therein which also passes through said cavity under a Venturi effect.

6. A knife assembly as recited in claim 5 wherein said body is open at said second end thereof, and wherein said means for reciprocating said movable cutting element comprises means defining a passage away from said body in fluid communication with said body second end.

7. A knife assembly as recited in claim 5 wherein said body first end has a termination slanting downwardly from said body cavity open top, and wherein said flexible tube enters said first opening beneath said termination.

8. A knife assembly as recited in claim 6 wherein said means for reciprocating said cutting element further comprises a cam engaging element, said means defining a passage defining said passage in said cam engaging element, and means for biasing said cam engaging element so that it is biased to normally move said first end of said movable cutting element into engagement with said stationary cutting element.

9. A knife assembly as recited in claim 1 wherein said means for reciprocating said movable cutting element comprises a pneumatic actuator, said pneumatic actuator having a shaft connected to said movable cutting element, and comprising:

a body defining an interior cylindrical bore, having means defining an opening therein for introduction of gas under pressure;

a piston integral with said shaft, and having a piston face, opposite said shaft, which is engaged by gas under pressure, said piston mounted in said cylinder for reciprocal movement therein;

means defining an opening in said piston face, including an interior bore parallel to said cylindrical bore;

a stationary rod extending from said body into said piston interior bore;

an O-ring having an outside diameter, and compressibility, such that said O-ring can sealingly engage said piston interior bore and prevent gas from passing therepast;

means for mounting said O-ring with respect to said piston so that said O-ring moves with said piston, providing a gas-tight seal preventing gas from said cylindrical bore opening passing into said piston interior bore, a first distance, and after said O-ring and piston have moved together said first distance said piston continues to move while said O-ring does not so that there is relative movement therebetween and the seal between said O-ring and said piston interior bore is broken, and gas from said cylindrical bore opening may freely pass into said piston interior bore; and vent means for venting gas passing into said piston interior bore.

10. A knife assembly as recited in claim 3 further comprising a second opening in said first end of said body adjacent said first opening, and open to the atmosphere, so that compressed air passing through said tube entrains atmospheric air therein which also passes through said cavity under a Venturi effect.

11. A thread cutting knife assembly for an automatic sewing machine comprising:

a top plate defining a surface over which thread passes, and elongated in a first dimension;

a body member having an open top cavity therein, and a first end and a second end, said first and second ends spaced from and opposite each other in said first dimension;

said top plate covering said body member cavity open top;

means for effecting air flow under pressure within said cavity from said body first end toward said body second end in said first dimension;

cutting means associated with said body member for cutting a leading or trailing thread from a cloth passing over said top plate; said cutting means comprising:

a movable cutting element elongated in said first dimension, and disposed between said top plate and said body member, having a cutting portion at a first end thereof adjacent said body first end, and an engagable portion at a second end thereof spaced from and opposite said first end in said dimension of elongation;

a stationary cutting element positioned closer to said body first end than said top plate, and disposed over said body cavity; and means for reciprocating said movable cutting element in said first dimension, said means for reciprocating engaging said engagable portion of said movable cutting element.

12. A knife assembly as recited in claim 11 wherein said air flow effecting means comprises a tube extending outside said body from connection to a source of air under pressure adjacent said body second end to a first opening in said first end of said body.

13. A knife assembly as recited in claim 12 further comprising a second opening in said first end of said body adjacent said first opening, and open to the atmosphere, so that compressed air passing through said flexible tube entrains atmospheric air therein which also passes through said cavity under a Venturi effect.

14. A knife assembly as recited in claim 13 wherein said body is open at said second end thereof, and wherein said means for reciprocating said movable cutting element comprises means defining a passage away from said body in fluid communication with said body second end.

15. A knife assembly as recited in claim 13 sewing needle, a pressure foot, a throat plate, feed dogs, and a leading or trailing thread cutting knife assembly;

said knife assembly operatively positioned with respect to said sewing needle, pressure foot, throat plate, and feed dogs to receive cloth stitched with thread by said needle, the cloth moving in a first direction in a first dimension with respect to said knife assembly; and said knife assembly comprising: a body member having an open top cavity therein, and a first end and a second end, said first and second ends spaced from and opposite each other in said first dimension, and said first end preceding said second end in said first direction; a top plate defining a surface over which the thread passes, a portion of the thread capable of passing into said cavity; said top plate covering said body member cavity open top; a movable cutting element elongated in said first dimension, and disposed between said top plate and said body member, having a cutting portion at a first end thereof adjacent said body first end, and an engagable portion at a second end thereof spaced from and opposite said first end in said dimension of elongation; a stationary cutting element positioned closer to said body first end than said top plate, and disposed over said body cavity; means for reciprocating said movable cutting element in said first dimension, said means for reciprocation engaging said engagable portion of said movable cutting element; and means for effecting air flow within said cavity from said body first end toward said body second end in said first dimension.

16. An automatic sewing machine as recited in claim 15 further including cams, and wherein said means for reciprocating said movable cutting element is disposed in operative association with a cam of said sewing machine and is moved by said cam to a position in which said movable and stationary cutting elements do not cooperate, and is moved by a spring bias into a position in which said movable and stationary cutting elements do cooperate.

17. An automatic sewing machine as recited in claim 15 wherein said means for reciprocating said movable cutting element comprises a pneumatic actuator, said pneumatic actuator having a shaft connected to said movable cutting element, and comprising:

a body defining an interior cylindrical bore, having means defining an opening therein for introduction of gas under pressure;

a piston integral with said shaft, and having a piston face, opposite said shaft, which is engaged by gas under pressure, said piston mounted in said cylinder for reciprocal movement therein;

means defining an opening in said piston face, including an interior bore parallel to said cylindrical bore;

a stationary rod extending from said body into said piston interior bore;

an O-ring having an outside diameter, and compressibility, such that said O-ring can sealingly engage said piston interior bore and prevent gas from passing therepast;

means for mounting said O-ring with respect to said piston so that said O-ring moves with said piston, providing a gas-tig seal preventing gas from said cylindrical bore opening passing into said piston interior bore, a first distance, and after said O-ring and piston have moved together said first distance said piston continues to move while said O-ring does not so that there is relative movement therebetween and the seal between said O-ring and said piston interior bore is broken, and gas from said cylindrical bore opening may freely pass into said piston interior bore; and vent means for venting gas passing into said piston interior bore.

18. An automatic sewing machine as recited in claim 15 wherein said air flow effecting means comprises a tube extending outside said body from connection to a source of air under pressure adjacent said body second end to a first opening in said first end of said body to effect a flow of air under pressure through said cavity.

19. An automatic sewing machine as recited in claim 18 further comprising a second opening in said first end of said body adjacent said first opening, and open to the atmosphere, so that compressed air passing through said tube entrains atmospheric air therein which also passes through said cavity under a Venturi effect, and wherein said body is open at said second end thereof, and wherein said means for reciprocating said movable cutting element comprises means defining a passage away from said body in fluid communication with said body second end.

* * * * *